US006851793B2

(12) United States Patent
de Peña

(10) Patent No.: US 6,851,793 B2
(45) Date of Patent: Feb. 8, 2005

(54) VERY COST-EFFECTIVE INCREMENTAL PRINTING METHOD AND APPARATUS TO DIRECTLY REDUCE BIDIRECTIONAL HUE SHIFT

(75) Inventor: Sascha de Peña, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/349,063

(22) Filed: Jan. 22, 2003

(65) Prior Publication Data

US 2004/0141026 A1 Jul. 22, 2004

(51) Int. Cl.[7] ..... B41J 2/21; B41J 29/38
(52) U.S. Cl. ..... 347/43; 347/9
(58) Field of Search ..... 347/43, 9, 12, 347/40, 15

(56) References Cited

U.S. PATENT DOCUMENTS 6,341,841 B1 * 1/2002 Shimada et al. ..... 347/43
6,595,612 B1 * 7/2003 Brown et al. ..... 347/9
6,652,066 B2 * 11/2003 Teshigawara et al. ..... 347/41

FOREIGN PATENT DOCUMENTS

EP 955174 A2 * 11/1999 ..... B41J/19/14

* cited by examiner

*Primary Examiner*—Thinh Nguyen
(74) *Attorney, Agent, or Firm*—Peter I. Lippman

(57) ABSTRACT

A program controls colorant-applying elements (e.g. nozzles) individually, to apply colorants in an order that yields consistent colorant-addressing sequences. In another aspect, the invention inhibits particular elements in particular installments (e.g. printing passes) to produce a fixed color bias between colorants of at least one colorant pair; the other colorant is statistically downweighted to correct the bias. In a third aspect, a printmask-generating program automatically makes a usable mask based on neighborhood and timing constraints; this program is constrained, so as to minimize or eliminate hue shift.

24 Claims, 4 Drawing Sheets

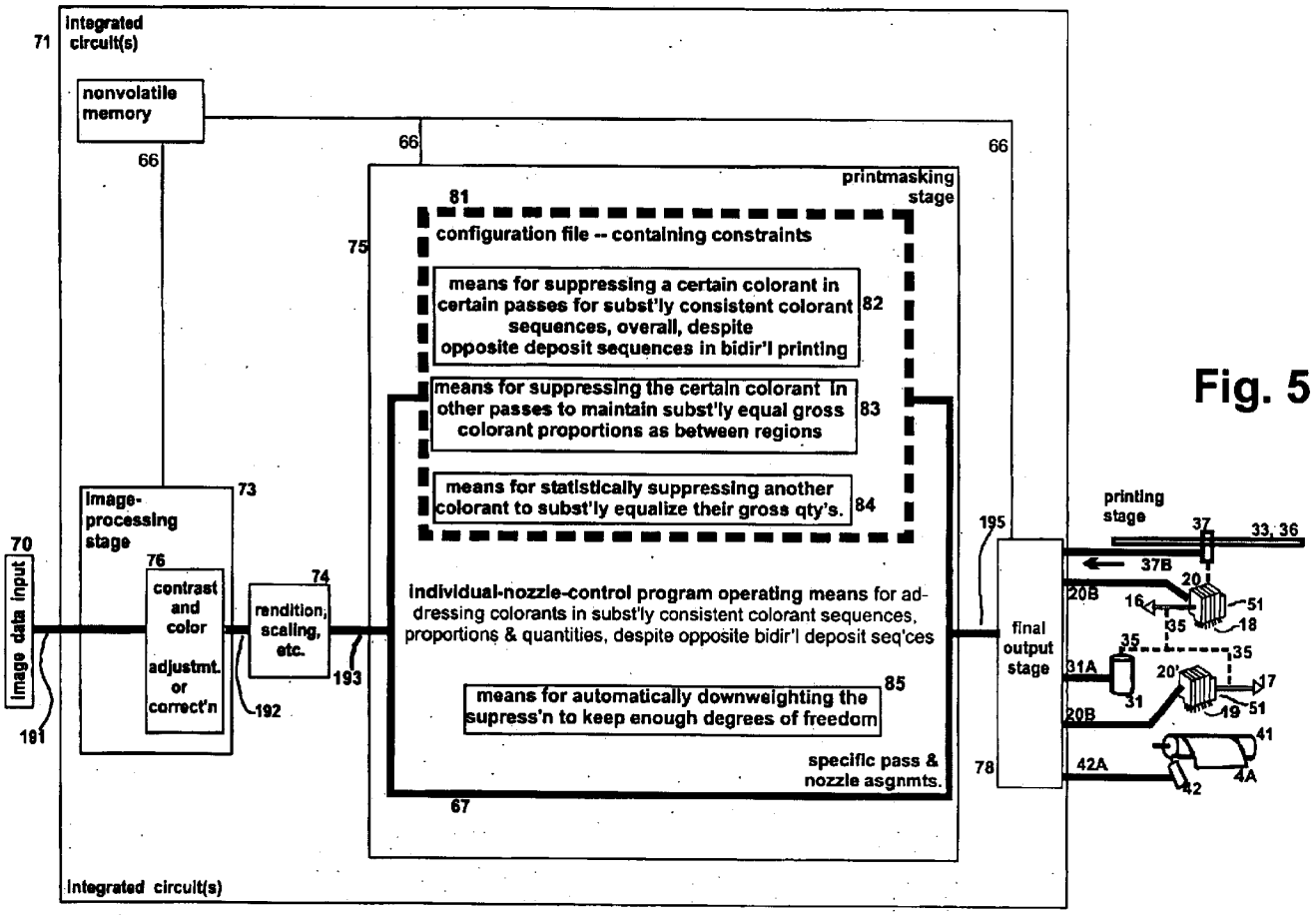
Fig. 5
printing stage
final output stage
printmasking stage
configuration file -- containing constraints
means for suppressing a certain colorant in certain passes for subst'ly consistent colorant sequences, overall, despite opposite deposit sequences in bidir'l printing
means for suppressing the certain colorant in other passes to maintain subst'ly equal gross colorant proportions as between regions
means for statistically suppressing another colorant to subst'ly equalize their gross qty's.
Individual-nozzle-control program operating means for addressing colorants in subst'ly consistent colorant sequences, proportions & quantities, despite opposite bidir'l deposit seq'ces
means for automatically downweighting the supress'n to keep enough degrees of freedom
specific pass & nozzle asgnmts.
rendition, scaling, etc.
image-processing stage
contrast and color adjustmt. or correct'n
nonvolatile memory
Integrated circuit(s)
Integrated circuit(s)
image data input

VERY COST-EFFECTIVE INCREMENTAL PRINTING METHOD AND APPARATUS TO DIRECTLY REDUCE BIDIRECTIONAL HUE SHIFT

RELATED PATENT DOCUMENTS

Closely related documents are other, coowned U.S. utility-patent documents—hereby wholly incorporated by reference into this document. Those documents are in the names of:

Joan-Manel Garcia-Reyero et al., U.S. Pat. No. 6,443,556, "IMPROVEMENTS IN AUTOMATED AND SEMI-AUTOMATED PRINTMASK GENERATION FOR INCREMENTAL PRINTING"—and earlier documents cited therein—as well as Ser. No. 09/150,321, "MASKS ON DEMAND FOR USE IN INCREMENTAL PRINTING", and Ser. No. 09/150,322, "FAST BUILDING OF MASKS FOR USE IN INCREMENTAL PRINTING", issued as U.S. Pat. No. 6,542,258; and Ser. No. 09/150,323, "OPTIMAL-SIZE AND NOZZLE-MODULATED PRINTMASKS FOR USE IN INCREMENTAL PRINTING", issued as U.S. Pat. No. 6,788,432;

Antoni Gil et al., Ser. No. 09/775,771, "EXTERNALLY CUSTOMIZED TONAL-HIERARCHY CONFIGURATION AND COMPLEMENTARY BUSINESS ARRANGEMENTS, FOR INKJET PRINTING", Antoni Gil et al., Ser. No. 10/236,612, "REMOVAL OR MITIGATION OF ARTIFACTS IN INCREMENTAL PRINTING", issued as U.S. Pat. No. 6,799,823.

Sascha de Peña Hempel et al., Ser. No. 10/237,195, "REMOVAL OR MITIGATION OF ARTIFACTS IN COMPOSITE-COLOR INCREMENTAL PRINTING",

FIELD OF THE INVENTION

This invention relates generally to machines and procedures for incremental printing of text or graphics on printing media such as paper, transparency stock, or other glossy media; and more particularly to such printing by colorants that form colors dependent upon deposition sequence—such as, for example, liquid colorants.

BACKGROUND (a) The hue-shift problem—A common practice in the field of incremental printing, including inkjet and other liquid- or semiliquid-based technologies, is to produce secondary colors by placing one or more dots of each of plural primary colorants one on top of another, i.e. dot-on-dot printing. Ideally, colorants are conceptualized as mixing completely and forming the same color regardless of the order in which they are printed.

Unfortunately, however, when printing on practical printing media the first colorant printed immediately spreads out and penetrates into the medium. This phenomenon changes the surface and the initial conditions for the following drops.

The results include incomplete ink mixing, and asymmetrical effective concentrations of colorant. From these in turn there arises a hue shift, which depends on both the order and the timing of the dot-on-dot printing.

The order is particularly critical because a very effective way of obtaining high printing throughput is to print bidirectionally. This means, when using a scanning carriage 20 (FIG. 1) that transports printheads 23–26 across the printing medium 15, to print while the carriage is moving in each direction 16, 17 rather than just one or the other.

The desirability of high throughput emerges from the extremely competitive marketplace in incremental printers, with its intense demand for both high throughput and high image-color quality—as well as low price. Bidirectional operation answers this demand by making the most of the time needed to return the carriage for another printing pass. A nonprinting retrace or return pass at slewing speed is faster than a printing pass, but not infinitely fast.

(b) Origin of hue shift—The implication of such bidirectional operation, however, is a reversal in the order 11–14, 11'14 15' of colorant C, M, Y, K deposition—because printheads are ordinarily mounted on the carriage in a fixed order along the scan axis. Therefore, colorant deposition is correspondingly in one fixed order 11–14 when the carriage is moving in one direction—but in the opposite order 11'–15' on retrace.

Because of the above-mentioned interactions between the colorant and the printing medium, this reversal of deposition order results in two different colors even for identical image data. This topic will require familiarity with concepts of "printmasking" and plural-pass "printmodes", which are introduced briefly in subsection (e) below.

In a single-pass printmode, the colorant first deposited on the printing medium tends to predominate. Laying down dots of cyan 11 above dots of yellow 13, simply due to scanning rightward 17, produces a green that is biased toward the yellow.

Conversely, applying yellow 12' above cyan 14', due to scanning leftward 16, produces a green that is biased toward the cyan. This difference arises even though the printing medium 15 itself, and the carriage 20, pens 23–26 and colorants C, M, Y, K are all identical in the two circumstances.

In a three-pass mode the situation is more complicated. Although a slight tendency persists for predominance of the first colorant deposited, a more prominent effect is that the predominant colorant is the one with higher concentration near the medium 15.

(As will be understood, some types of colorants or media may invoke a different, and even opposite, hue-shift behavior. For example, with some inks or media, or combinations of inks and media, the predominant color may arise from the last colorant deposited—or from colorants with higher concentration far from the media. Judicious application of the principles taught this document can resolve hue shifts in those ink-media regimes as well.)

A typical conventional three-pass mode provides overlapping swaths 31–34 (FIG. 2). Due to periodic advance 18 of the print medium 15, each swath (e.g. 32) is stepped relative to its two nearest neighbors (e.g. 31, 33) by one-third of their common heights. Each swath 32 therefore overlaps those two neighbors 31, 33 by one-third of that common swath height.

To understand how this generates a complex hue shift, consider the two portions 35, 36 of an image designated region 1 and region 2. Region 1 (upward hatched in the drawing) is formed from swaths made in three passes 31–33, namely the bottom or leading one-third of the rightward-scanning 17 first-pass swath 31, the center one-third of the leftward-scanning 16 second-pass swath 32, and the top or trailing one-third of the again-rightward-scanning 17 third-pass swath 33.

In summary, region 1 has three sets of colorant layers, with alternating directionalities 17, 16, 17 respectively.

Region 2 (downward hatched) is instead formed from swaths made in three passes 32–34 of oppositely alternating directionalities 16, 17, 16.

These are the bottom or leading one-third of the leftward-formed 17 second swath 32, the center one-third of the rightward-formed 16 third swath 33, and the top or trailing third of the leftward-formed 17 fourth swath 34. Both sequences are bidirectionally alternating, and both deposit exactly the same amounts of the same colorants; but the two sequences start with different scan directions 17, 16 respectively.

To simplify the description slightly, this discussion will first focus attention on only the construction of a green 40*g* (FIG. 3) colorant lamination formed by cyan C and yellow Y colorants. The bottom two layers, a C layer above a Y layer, are formed by the bottom, leading third 43 of the rightward 17 first-pass swath; therefore after the first pass the pattern 61 is simply "CY", reading from the top layer downward toward the printing medium.

The next two layers, a Y above a C, are formed by the central third 42 of the leftward 16 second-pass swath. Therefore after the second pass the aggregated pattern 62 is "YCCY", again reading from the topmost colorant layer downward toward the print medium.

The final two layers, again a C above a Y, are formed by the top, trailing third 41 of the rightward 17 third-pass swath, so that the final aggregated pattern 63, still reading through the laminations from the top down, is "CYYCCY". Green 40*g* (the portion above region divider 47) is accordingly formed as just that pattern 41*g*–42*g*–43*g*. The fourth pass 34 does not print in the first region 35 at all.

Now for comparison the behavior in region 2 is built up in the same way from three passes—but now they are the second, third and fourth passes respectively, so as mentioned earlier the alternations are opposite in order. Starting with the bottom one-third 46 of the leftward second pass, this sequence continues with the central one-third 45 of the rightward third pass, and concludes with the top one-third 44 of the leftward fourth pass.

Immediately after the first pass 31 (FIG. 2) there is no colorant in region 2, as the second pass 32 is the earliest one to provide any colorant in that region 2. After the second pass 32, region 2 has a top-down colorant-deposition pattern 54 (FIG. 3) of just two installments "YC".

After the third pass the aggregate colorant-deposition pattern 55 is "CYYC". After the fourth, the pattern 56 is "YCCYYC", forming green 40*g* (the portion below region divider 47) as a pattern 44*g*–45*g*–46*g*.

Now it is possible to directly compare the two colorant installment patterns:

| region 1 | region 2 |
|---|---|
| C | Y |
| Y | C |
| Y | C |
| C | Y |
| C | Y |
| Y | C. |

In region 1, although there are two Y installments in a row (the second and third installments), physically those two deposits of yellow may be regarded as merging into simply a thicker layer of yellow.

The same is true for the two Y installments in region 2 (the fourth and fifth installments). The analogous observation holds for the two C installments in each region.

Taking these merging phenomena into account, the overall sequence can be simplified by looking at colorant layers rather than installments:

| region 1 | region 2 |
|---|---|
| C | Y |
| Y | C |
| C | Y |
| Y | C. |

This tabulation makes clear that colorant sequences in the two regions even if considered disregarding the number of installments in each colorant layer, are fundamentally different.

These tabulations show that colorant nearest the printing medium (the bottom of the tabulation) is opposite for the two regions. To the extent that the concentration of colorant nearest the medium tends to control apparent hue more strongly than colorant elsewhere (as is often theorized), these two colorant-layer patterns show that there is an intrinsic problem to be solved.

On the other hand, the colorant farthest from the medium (the top of the tabulation) is also opposite for the two regions. To the extent that the concentration farthest from the medium tends to control apparent hue more strongly than colorant elsewhere (as is also sometimes theorized), the tabulated patterns affirm that there is still an intrinsic problem to be solved. Hue is accordingly biased toward cyan in one of the regions and toward yellow in another.

Based on this presentation, it can be appreciated—without repeating the foregoing full development—that red 40*r* colorant layers similarly are formed as "MYYMMY" in region 1 (the aggregate of patterns 41*r*–42*r*–43*r*) and as "YMMYYM" in region 2 (from patterns 44*r*–45*r*–46*r*). The perceived hue is therefore biased toward magenta in one region and yellow in the other. Similarly a viewer sees blue 40*b* as magenta-biased in one region, but cyan-biased in the other.

This example is based upon a three-pass printmode. Any successful method for removing or minimizing the hue shift must be usable and effective in printmodes with very few printing passes or so-called successive "installments" of colorant deposition. This condition too flows from marketplace pressure for high throughput.

(c) Direct mitigation of hue shift—Heretofore, favored approaches for tackling the hue-shift problem have been relatively direct—either printing unidirectionally, or using printmodes that couple a certain number of printing passes with half that number of print-medium advances. The latter repeats each swath in both print directions, i.e. proceeding with a sort of limp, using N passes with N/2 advances.

Both these approaches actually physically eliminate the hue shift by removing its underlying causes. In principle these solutions are extensible to printmodes with few passes, but they are disadvantageous in that they significantly degrade throughput. As mentioned above, full bidirectional printing is the fastest way to complete an image, and the limping mode represents a throughput compromise.

In addition, the second of these approaches is susceptible to an artifact known as boundary banding. This is true because the limping mode doubles and thereby aggravates the undesirable deposition, within very short times, of relatively large amounts of ink along the edge of a swath. Although ordinary amounts of boundary banding may be mitigated by the methods introduced in the Gil and De Peña patent documents mentioned above, some small degree of image distortion may arise when boundary banding is doubled as suggested here.

A third direct approach uses symmetrical pen configurations, as suggested for example in Japanese patent publication 58215351 (1983) and U.S. Pat. No. 4,593,295 (1986)—both of Matsufuji Yoji et al.—and also U.S. Pat. No. 4,528,576 of Nobutoshi Mitzusawa et al. Such symmetrical constructions force drop orders in both print directions to be identical, by duplicating the occurrence of each colorant in a symmetrical way around a central reference pen—e.g., magenta-cyan-yellow-cyan-magenta (MCYCM).

This approach may present a perfect solution in the sense of maintaining full throughput without hue shift, but requires major mechanical changes. In general it is likely that for such a printer, the electrical connection system must be augmented and the processor configured.

Further, the carriage must be slightly wider, leading to enlargement of guiderails and the drive belt, codestrip and overall case. This last-mentioned change in turn impacts the cost of packaging, shipping, and inventory (storage).

For those users who are particularly concerned about the very highest color quality and fidelity, such relatively small increases are likely to be acceptable—and it is certainly not intended to criticize this solution. Users who are less demanding, however, may object to the results of these added cost elements.

It may be difficult to determine what fraction of all users may be so inclined. Hence the overall cost effectiveness of symmetrical pen configurations is uncertain.

(d) Indirect mitigation of hue shift—An indirect approach does not tackle the hue-shift problem at its source but instead attempts to conceal it. One such approach is use of bidirectional printmodes with a high number of passes, particularly eight and more.

This tactic provides drop-order statistics sufficient to keep the hue-shift effect below the threshold of human perceptibility. As noted above, however, modernly use of printmodes with high numbers of passes is disfavored—and reduction of the number passes exposes the effect. Image quality achievable with few passes is poor, especially for odd numbers of passes.

(e) Modern printmasking—As mentioned above, heretofore printmasking has been associated with hue-shift mitigation only to the extent of camouflaging the hue effect by dilution in a relatively large number of passes. Printmasking, as implied by the discussion above and as well known in the incremental-printing field, enables laying down in each pass of the pens only a fraction of the total ink required in each section of the image—so that any areas left white in each pass are filled in by one or more later passes.

This tends to control bleed, blocking and cockle by is reducing the amount of liquid that is all on the page at any given time, and also may facilitate shortening of drying time. In fact multipass printmasking tends to hide not only hue shift but also a great variety of other undesirable artifacts in incremental printing; unfortunately, however, multipass printmodes are very slow.

The specific partial-inking pattern employed in each pass, and the way in which these different patterns add up to a single fully inked image, is known as a "printmode". Some printmodes such as square or rectangular checkerboard-like patterns tend to create objectionable moire effects when frequencies or harmonics generated within the patterns are close to the frequencies or harmonics of interacting subsystems. Such interfering frequencies may arise in dithering subsystems sometimes used to help control the paper advance or the pen speed.

One particularly simple way to divide up a desired amount of ink into more than one pen pass is the checkerboard pattern mentioned above: every other pixel location is printed on one pass, and then the blanks are filled in on the next pass.

To avoid horizontal "banding" problems (and sometimes minimize the moiré patterns) discussed above, a print mode may be constructed so that the paper advances between each initial-swath scan of the pen and the corresponding fill-swath scan or scans. As illustrated in section (b) above, this can be done in such a way that each pen scan functions in part as an initial-swath scan (for one portion of the printing medium) and in part as a fill-swath scan.

Because regular printmasking patterns themselves create new artifacts, it was for several years believed that random or randomized masking would be the key to eliminating repetitive artifacts. This belief suffered from two misunderstandings.

First, even masks formed by entirely random processes generate extremely objectionable repetitive patterns, and indeed sometimes quite bizarre ones, when tiled (stepped repeatedly across and down) for use in a sizable image. As taught in the Garcia patent documents mentioned earlier, this defect arises when individual masks are small—meaning, ordinarily, smaller than roughly two to three centimeters (one inch) across.

Second, even large masks when made randomly produce unacceptable images. This phenomenon follows the well-known capability of truly random sequences to include long repetitive runs.

Thus, merely by way of example, there is a nonzero probability that a random-number generator will generate twelve zeroes in a row. The same is true for nine sevens, eleven thirteens, etc. Of course such coincidences arise in meaningful quantities only in very large streams of numbers—but such very large streams are the norm when considering image data, which typically run to several million colorant-pixels in a standard magazine-size page.

In the aggregate all these probabilities come up to a rather common occurrence of clumping in numerical arrays. In images printed with masks generated by random-number techniques, such clumping manifests itself as granularity, graininess, particularly in image highlight regions.

The remarkable Garcia documents show both how to avoid tiling of too-small unit masks and how to control the degree of randomness in mask generation, to obtain an ideal tradeoff between repetitive-mask artifacts and graininess. Garcia accomplishes this by running programs, entitled "Shakes", that can generate a usable mask at each attempt—even on the fly, just ahead of print-engine operations, in real time.

He conditions these program operations by directing the programs to obtain critical constraints as parameters from an easily accessible configuration file. The constraints include so-called "neighborhood" constraints for controlling e.g. the relative proximity of pixel positions printed in the same pass or immediately successive passes.

The term neighborhood is understood as three dimensional, to encompass pixel-addressing opportunities that are "near" one another in terms of numbers of passes (i.e. time) as well as more simply in terms of the pixel grid on the print medium. The Garcia programs—like incremental printers in general—can operate in software or in firmware, or even in hardware (application-specific integrated circuits or "ASICs"). The configuration file is advantageously kept simple and open so that a system designer can modify it straightforwardly.

To enable adjustment of the relative amount of randomness, the configuration file accepts constraint values for interpretation as probabilistic weighting factors. In the Shakes regime these values are central to actual performance, as Shakes defines almost all operations in terms of relative probabilities or preferences rather than absolute constraints—thereby allowing the program enough degrees of freedom to find an actual mask solution in every attempt. (It will later be seen that this property of Shakes also protects that printmasking system against certain aspects of the present invention that could otherwise cause Shakes itself to fail.)

The Garcia developments include, in addition to the basic Shakes programs, a two-stage strategy that meets all the nozzle weighting requirements within an acceptable processing time. His mask generation incorporates a first so-called "precooking" process that is plot independent, performed just once; and then a later so-called "cooking" or "popup" process that is performed before each plot and if desired can be conditioned by metrics developed from the character of the plot itself.

The precooking process creates a preference-sorted set of mask texture candidates, depending only on nozzle neighborhood conditions—defined for each set of maskbuilding constraints. The cooking or popup process selects one of the various available precooked mask levels.

Cooking also replicates those levels in such a way that the different printheads do not print onto the same pixel in the same pass. Eventually the cooking phase takes into consideration nozzle-weighting features, firing frequency and mask parity restrictions corresponding to each printhead.

Heretofore the Garcia systems have not been associated with solutions to the hue-shift problem.

(f) Conclusion—Thus persistent problems of hue shift in bidirectional operation have continued to impede achievement of uniformly excellent inkjet printing—at high throughput. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is apparatus for printing an image with multiple colorants, onto a printing medium. The apparatus includes plural pens, each ejecting a different colorant respectively and each having an array of multiple nozzles.

Also included are some means for operating each pen to eject successive installments of the colorants. For purposes of generality and breadth in discussion of the invention, these means will be called simply the "pen-operating means".

It is to be understood that the successive colorant installments are subject to varying colorant-addressing sequences. For purposes of this document the term "addressed" or "addressing" is included to make clear that what is being discussed is equalization of printmasking, i.e. of opportunities to print—not necessarily of actual printed colors.

The latter necessarily vary with image detail. Equalization of colorant addressing to the pixel grid does manifest itself in equalized or consistent actually printed color, but only to the extent that image data define a common, uniform color field encompassing the compared regions or colorant quantities.

While the primary focus of this document is hue shift arising in bidirectional printing, variation of colorant-addressing concentrations may occur due to other causes. These are within the scope of this facet of the invention.

In addition the apparatus includes some means for operating a program to control the nozzles individually. These means cause the nozzles to deposit the colorants in an order that maintains substantially consistent colorant-addressing sequences.

Again for breadth and generality, these latter means will simply be called the "program-operating means". The pen- and program-operating means most typically take the form of portions of one or more processors operating a program or programs—and these can be electronic or optical processors. The program or programs themselves may be in the form of software, firmware or hardware (e. g. ASICs).

The foregoing may constitute a description or definition of the first facet of the invention in its broadest or most general form. Even in this general form, however, it can be seen that this aspect of the invention significantly mitigates the difficulties left unresolved in the art.

In particular, whereas other direct systems for removing hue shift were basically macroscopic, the present apparatus does the same job but on a basis that is microscopic. Thus the earlier direct systems physically controlled the movements of the entire printhead and carriage system, or wholly reconfigured that system, to correct the colorant deposition sequences.

The present instead system accomplishes the same objective at virtually no cost, with no reconfiguration of macroscopic systems—or of their macroscopic operation—merely through operation of one or more control programs. The implications of this approach upon engineering-change requirements is far less drastic, and cost effectiveness is therefore far superior.

This system is also much better than previous indirect systems, i.e. those using multipass printmodes, as they were powerless to improve hue shift without severely degrading throughput—by requiring as many as eight or more passes. As will be seen, the present system can do as well or considerably better with as few as four or in some cases even three passes.

Although this aspect of the invention in its broad form thus represents a significant advance in the art, it is preferably practiced in conjunction with certain other features or characteristics that further enhance enjoyment of overall benefits. One such basic preference is that some colorant-addressing layers in the substantially consistent colorant-addressing sequences include different numbers of installments.

Another basic preference is particularly applicable for apparatus in which—with respect to each portion of the medium—in each installment the pen-operating means alternate between two fixed but opposite pen sequences. For an apparatus that works in this way, it is preferred that the program-operating means include some means for maintaining the substantially consistent colorant-addressing sequences notwithstanding operation of the pens in the opposite sequences.

When this basic preference is observed, a still more specific case is that the apparatus further include a carriage for transporting the pens in a fixed configuration across the medium in alternating directions, thereby causing the pen-operating means to alternate between the two fixed but opposite pen sequences. In other words, this is the bidirectional-printing case. The significance of this particular express preference is that one direct approach to avoiding hue shift, as described in an earlier section of this document, was to restrict operation to monodirectional printing.

Yet another specific case is that the apparatus further include a mechanism that advances the printing medium, at right angles to the carriage motion, substantially only between each successive pair of carriage transits. The significance of this is that another direct approach to avoidance of hue shift exploited the properties of a so-called "limping" system—also described in the earlier section of this document.

Another subpreference, in event the basic situation of two pen sequences obtains, is that the maintaining means minimize hue shift as between colors formed in the two pen sequences respectively. Another basic preference is that the program-operating means include means for suppressing use of particular nozzles in particular installments to maintain the substantially consistent colorant-addressing sequences.

In this last-mentioned case, preferably the apparatus further includes printmasking means for allocating particular image pixels, in respective colors, to colorant deposition in particular installments. In this event, the suppressing means include constraints on operation of the printmasking means.

In preferred embodiments of a second of its aspects, the invention is a method of printing a color image on a printing medium, by construction from individual marks formed by scanning multinozzle pens. The method includes the step of passing the pens multiple times across the medium while firing the nozzles to form the marks.

It also includes the step of suppressing firing of particular nozzles in particular passes. The purpose of this suppression is to substantially maintain a fixed, specified color bias as between colorants of at least one colorant pair. (Although the term "addressing" is not used here, it will be clear that the suppression—and therefore the bias—are independent of the image and can be overcome if image data introduce a contrary influence.)

The foregoing may constitute a description or definition of the second facet of the invention in its broadest or most general form. Even in this general form, however, it can be seen that this aspect of the invention too significantly mitigates the difficulties left unresolved in the art.

In particular, according to this facet of the invention, a color-deposition sequence adequate to stabilize color bias is achieved merely by suppressing firing of certain nozzles in certain passes. This is a phenomenal result.

Although this second aspect of the invention in its broad form thus represents a significant advance in the art, it is preferably practiced in conjunction with certain other features or characteristics that further enhance enjoyment of overall benefits.3)

For example, one basic preference is that the method also include the step of selectively applying a relative downweighting in printing of one colorant, to substantially correct the color bias. This applying step produces substantially equal overall gross addressed quantities of the colorants.

(In other words, although the suppressing step considered alone would leave the system color symmetrical as between certain passes of the pens, and thus between certain different regions of the image—this symmetrical color would be an incorrect color, with one component incorrectly dominating the other. The downweighting of the subordinate color complements the suppressing step to produce a color that is still symmetrical with respect to passes and regions but is also the correct color.)

In event the downweighting preference is satisfied, then it is further preferred—to minimize residual hue mismatch as between different image regions—that the applying step further include using statistical weights perturbed from the nominal downweighting values. Otherwise the nominal values would only nominally equalize the overall colorant quantities, and in some cases the hues in different image regions would still not really appear perfectly equal.

Another basic preference is that the suppressing step include inhibiting particular marks of a certain colorant. This step operates to maintain substantially consistent colorant-addressing concentrations within the colorant pair. As suggested above this may lead to a subpreference of downweighting another colorant to make the colors resulting from those consistent concentrations also equal.

Yet another basic preference is that the suppressing step include inhibiting marks of at least two colorants, to produce a substantially fixed, specified color bias as between colorants of two colorant pairs.

One still-further nested preference, applicable if the different-colorant adjustments are in use as just described, is that the method further include the step of expressly setting a relative weight for the predominance of the suppressing step in relation to neighborhood constraints or other constraints, or both.

While all the previous stated preferences relate to printing of two secondary colors—constructed from the three colorants discussed—the stated constraints in fact overconstrain the problem of printmasking with respect to a third, secondary (or composite) color; and the method sometimes falls back on expressly setting a relative weight to control the predominance of the suppressing step and the neighborhood (etc.) constraints in relation to each other, as noted in the preceding paragraph, to relieve this overconstraint.

Still another preference, with respect to all of the functions discussed in connection with the second main aspect of the invention, is that the expressly-setting step include controlling printing of colors requiring said two colorants; and that the two colorants be cyan and yellow; and the secondary color, blue. Another basic preference is that the method further include the steps of printmasking to allocate particular image pixels, in particular colors, to marking in particular passes; and constraining the printmasking to implement the suppressing step.

In preferred embodiments of a third of its basic aspects or facets, the invention is a method for incremental printing of a color image. The method includes the step of operating a printmask-generating program that automatically creates a usable mask based upon neighborhood constraints and timing constraints specified to the program in advance.

It also includes the step of specifying, to the program, constraints to minimize or eliminate hue shift. Yet another step is printing the image with a resulting mask.

The foregoing may represent a description or definition of the third aspect or facet of the invention in its broadest or most general form. Even as couched in these broad terms, however, it can be seen that this facet of the invention importantly advances the art.

In particular, this aspect of the invention accomplishes what may seem to be astonishing sleight-of-hand: it minimizes or eliminates hue shift merely by entering certain simple constraints into a general, already-existing printmasking program.

Although the third major aspect of the invention thus significantly advances the art, nevertheless to optimize enjoyment of its benefits preferably the invention is practiced in conjunction with certain additional features or characteristics. Some of these are closely related to the preferences enumerated above in regard to the second facet of the invention.

In particular, preferably the constraints include inhibiting particular marks of a particular colorant to substantially equalize colorant-addressing sequences in different parts of the image. In this case, preferably the substantial equalization includes equalizing colorant-layer sequences, without regard to varying number of colorant installments (e.g. passes) making up some of those colorant layers.

Yet further preferably the constraints include downweighting of printing with another colorant. This is done in such a way as to substantially equalize colorant-addressing concentrations of the "particular colorant" and the "other colorant".

Relative to the preference just stated, a subpreference is this: to avoid residual hue mismatch between image regions, the downweighting step uses weights perturbed from values that would only nominally equalize concentrations.

If this subpreference is observed, then a still-further preference is that the constraints also include inhibiting particular marks of a different colorant, to substantially equalize further colorant-addressing sequences that include that different colorant. In this event the method also includes the step of expressly setting a relative weight for the predominance of the hue-shift-minimizing constraints in relation to other constraints. Yet another preference in this case is that the expressly-setting step include controlling the printing of colors requiring both the "particular colorant" and the "different colorant".

All of the foregoing operational principles and advantages of the present invention will be more fully appreciated upon consideration of the following detailed description, with reference to the appended drawings, of which:

BRIEF DESCRIPTION OF THE DRAWINGS

FIG. 5 is a block diagram, also very highly schematic, of apparatus according to preferred embodiments of the invention and particularly the above-discussed first aspect of the invention.

DETAILED DESCRIPTION OF THE PREFERRED EMBODIMENTS

1. Controlling Hue Shift by Inhibiting Specified Dots

Figure 1:
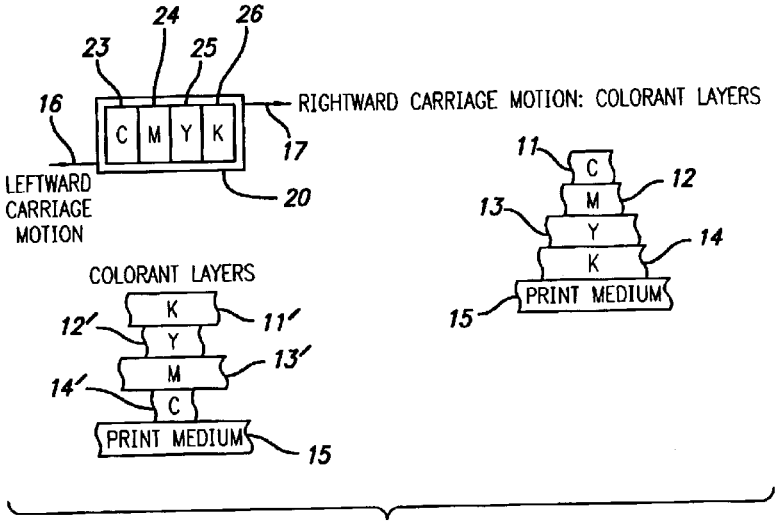
FIG. 1 PRIOR ART
FIG. 1 is a plan view, highly schematic, of a representative bidirectionally scanning printer carriage, holding printheads with four different colorants, respectively, in accordance with both prior art and preferred embodiments of the invention—and, associated with each of the two scanning directions respectively, a vertical cross-section, very highly schematic, showing deposited colorant layers.
Figure 2:
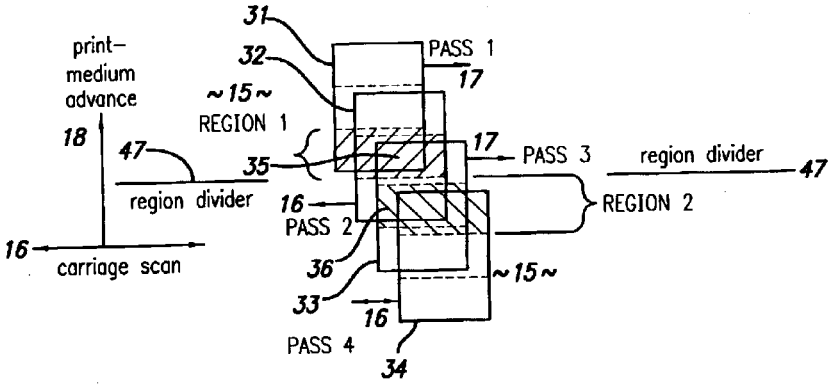
FIG. 2 PRIOR ART
FIG. 2 is a diagram in plan, also very highly schematic, of overlapping swaths printed onto a printing medium in a three-pass bidirectional printmode, and forming a basis for discussion of hue differentials between two adjacent regions on the medium.
Figure 3:
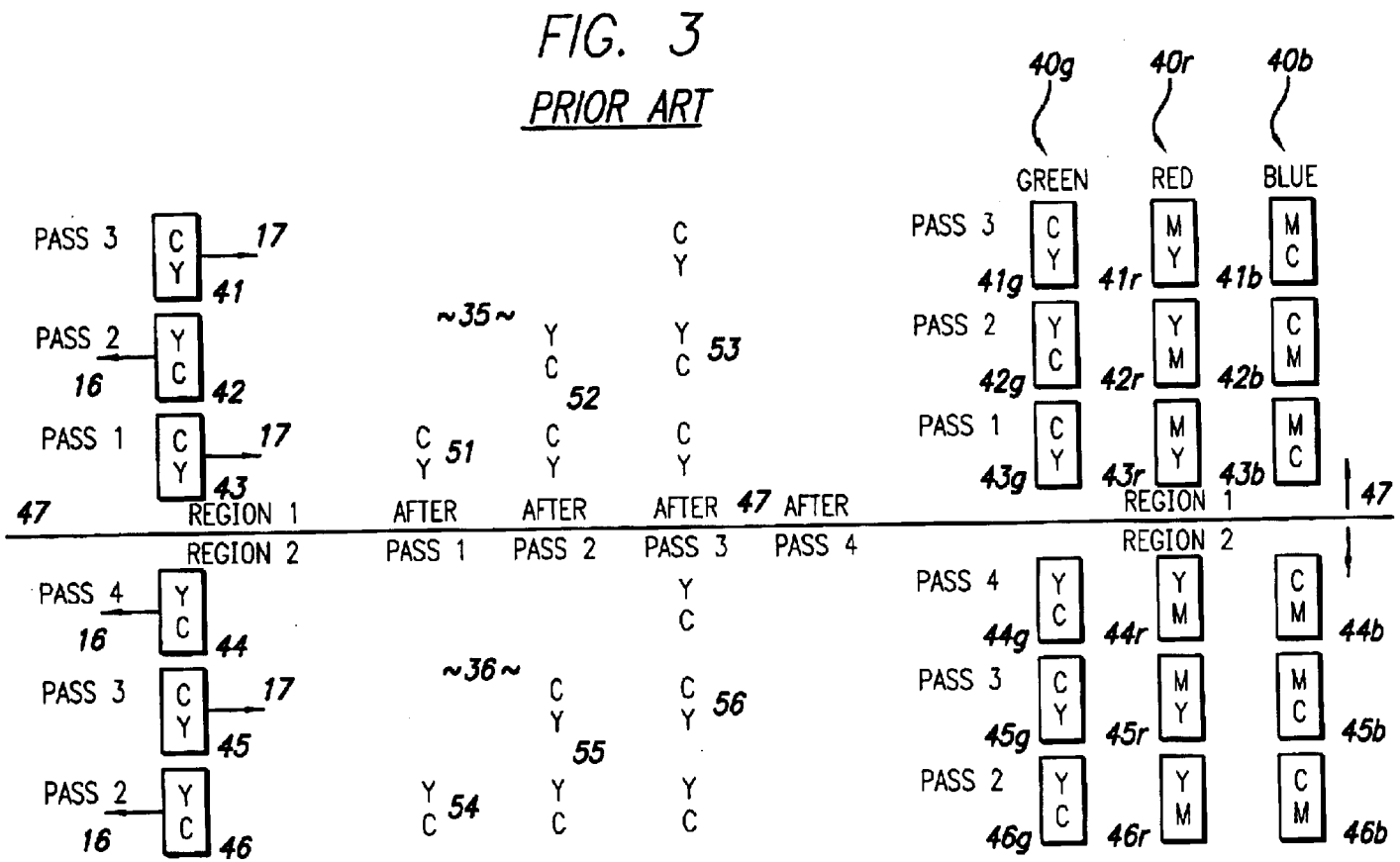
FIG. 3 PRIOR ART
FIG. 3 is a multipart diagram like the vertical sections of FIG. 1, of colorant deposition according to the FIGS. 1 and 2 geometries—for the two regions that are identified in FIG. 2 and also represented in FIG. 3 as regions respectively above and below a central horizontal dividing line; this diagram further shows associated effects upon simple secondary colors.

Continuing the example discussed in subsection (b) of the "BACKGROUND" section, the inconsistent colorant quantities addressed to the printing medium (FIG. 3) are corrected by two basic steps, taken up in subsections (a) and (b) below—followed by several other adjustments of varying importance, of which some are refinements and others might be characterized as "housekeeping":

(a) Equalizing hue shift—To harmonize green-forming colorant deposition sequences, both nearest the print medium and farthest from it, one cyan dot in each region is suppressed. That is the topmost dot in region 1, and the bottom-most dot in region 2.

Figure 4:
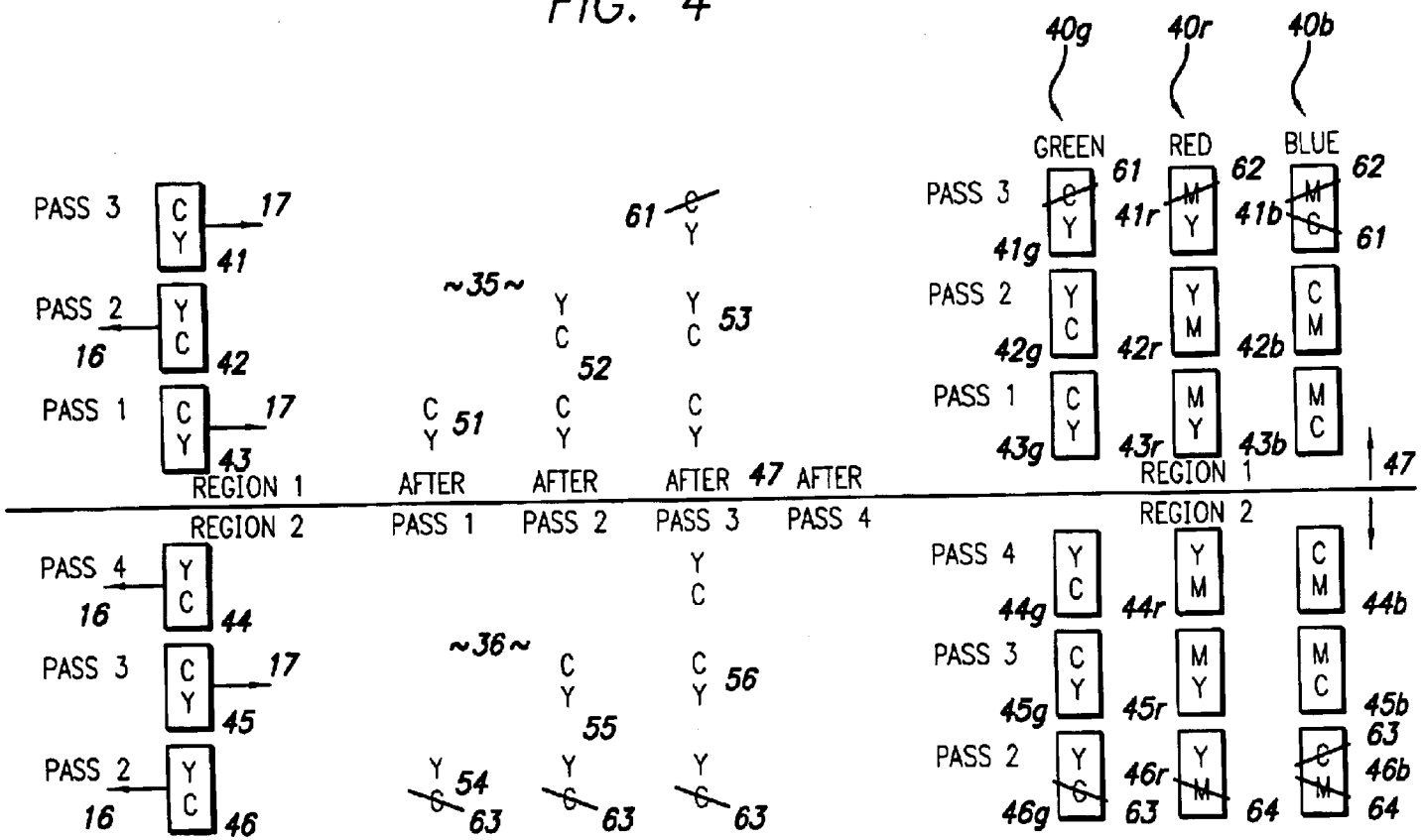
FIG. 4 is a diagram like FIG. 3 but showing suppression of particular colorant addressing in the various passes, and resulting modified colorant deposition patterns.

As to region 1, in other words, in the third pass 17 the cyan dot is suppressed 61 (FIG. 4). That represents deletion of all cyan dots addressed in the third pass in region 1.

This dot is thereby deleted 61 from the aggregate 9 pattern 53 after that third pass. It is accordingly deleted 61 from the green aggregate 40*g*, but also from the blue aggregate 40*b*—emphasizing, once again, that this embodiment of the invention deletes all cyan dots from the third pass in the first region.

As to region 2, similarly, in the second pass 16 the cyan dot is suppressed 63. That represents deletion of all cyan dots addressed in the second pass in region 2.

This dot is thereby deleted from the aggregate pattern 54 after the second pass; and also the patterns 55 after the third pass, and 56 after the fourth pass.

These two deletions are preferably accomplished simply by setting to zero the printmasking weights for cyan in these two pass/region combinations. Thus they correspond to constraints 82 (FIG. 5) in a configuration file 81 that controls the specific nozzles and pass assignments 67, in the printmasking stage 75.

Based upon these two deletions considered alone, ink addressing for all colorant installments is now changed—

| from this: | | to this: | |
|---|---|---|---|
| region 1 | region 2 | region 1 | region 2 |
| C | Y | — | Y |
| Y | C | Y | C |
| Y | C | Y | C |
| C | Y | C | Y |
| C | Y | C | Y |
| Y | C | Y | —. |

The significance of these changes may be more clearly seen from a layer tabulation, indicating that the original pattern of merged layers is changed—

| from this: | | to this: | |
|---|---|---|---|
| region 1 | region 2 | region 1 | region 2 |
| C | Y | Y | Y |
| Y | C | C | C |
| C | Y | Y | Y. |
| Y | C | | |

As in the earlier "BACKGROUND" section of this document, the layer tabulation disregards—for conceptual, tutorial purposes—the number of installments in each layer.

The colorant layer tabulation shows that the layer sequences (though not the colorant proportions) are now identical. As the installment tabulation shows, however, the yellow depositions potentially outnumber the cyan by three to two (3:2).

(b) Correcting gross colorant error—Curiously, this development leads to a new kind of error that is perhaps stranger: now both regions display yellow-green—what may be called chartreuse—rather than green. What began as a subtle hue shift between two regions, has now simply become a wholly incorrect color in the entire visual field.

Even more curiously, this seeming disaster is now only one more minor adjustments away from complete success—at least for the two colorants under consideration, cyan and yellow. Such adjustment is very simple: the relative proportion of yellow is reduced by ⅓, throughout the image, to reequalize the total amounts of the two colorants addressed to the medium. (By "relative proportion" here is meant the proportion of yellow in relation to cyan; this will become more clear momentarily.)

One way to accomplish this, merely by way of example (as many different numerical approaches can be used), is to apply weights thus:

| from this: | | to this: | |
|---|---|---|---|
| region 1 | region 2 | region 1 | region 2 |
| — | Y | — | Y × ½ |
| Y | C | Y × ¼ | C × ½ |
| Y | C | Y × ¼ | C × ½ |
| C | Y | C × ½ | Y × ¼ |
| C | Y | C × ½ | Y × ¼ |
| Y | — | Y × ½ | —. |

The total amount of yellow in each column is one unit (¼+¼+½=1), and the total amount of cyan also is one unit (½+½=1).

This reweighting corresponds to constraints 83 (FIG. 5) in the previously mentioned configuration file 81. As noted earlier, the Shakes printmasking stage 75 thereby controls the specific nozzles and pass assignments 67.

In each region the total amount of each colorant has been reduced to one unit—from three units for yellow and two for cyan. These reductions are by factors of three and two respectively; therefore in relative terms, as between the two colorants, the ratio of yellow to cyan has been reduced by ⅓ (e.g. from 3:2 to 2:2). This is the ⅓ relative reduction mentioned above, and is accomplished simply by a relative downweighting of yellow.

Although the overall proportions could be equalized by instead weighting the three yellow installments in each region at one-third (⅓), this would not have the beneficial effects of making the bottom layer of yellow in the two regions equal (both one-half), and the top layer of yellow likewise equal. That is to say, the installment-weight numbers stated above yield layers with these proportions:

| region 1 | region 2 |
|---|---|
| Y × ½ | Y × ½ |
| C × 1 | C × 1 |
| Y × ½ | Y × ½. |

Like the first adjustment introduced, this second one is very easy, and implemented through the printmask system—and this is a direct method, i.e. the overall result is to root out hue shift rather than only camouflaging its effects. As suggested, the Shakes regimen handles such changes of proportions in a trivial fashion, simply based on changing the numerical weights—which in operation of the program are interpreted as inking probabilities.

(c) Correcting possible residual mismatch due to timing—The layer tabulation just above shows that the two regions are now equalized as to both sequence and quantity of colorant deposition. The preceding installment tabulation, however, provides a reminder of a difference in timing:

The top yellow layer is deposited in two successive installments for region 1, but just one installment for region 2. An opposite relationship applies to the bottom yellow layers.

In purest principle the very slight variations in drying time, or in consistency, arising from these timing differences can yield extremely subtle differences in hue. Such differences, if seen at all, are much smaller than the hue shift values observed heretofore in the absence of the present invention.

In best practice of the invention the barest possibility of such residual mismatch should be tested with great care. Such a possibility is a matter of interactions between specific colorants with specific printing media using specific pen designs, and therefore cannot be resolved in the abstract.

Any such remaining color mismatches are typically due to drop-size variations—most-commonly arising from pen architecture peculiarities, or from pen-manufacturing tolerances. One way to compensate for such residual color imprecisions is through generally conventional closed-loop color calibration—and resulting linearization thresholds that are carried forward into the halftoning process, all as known in this field.

The invention is entirely amenable, however, to refinement of the weights that are developed in use of the present invention. Such refinement can eradicate any such residual mismatch that may be found. This can be accomplished very straightforwardly based on sensitive measurement and systematic exploration.

Another approach, which is perhaps peculiar to the present invention, is to measure mismatch of color in the two regions, and graph such mismatch against small perturbations in the ¼ and ½ weights tabulated for the installments, above. Ideal perturbations for resolving any observed hue mismatches—or if preferred some of such hue mismatches—are then quickly read out from such established three-dimensional relationships.

Ideally these values are loaded into firmware memory at the factory. This represents a particularly basic form of the weighting refinement module 84 (FIG. 5), again directly controlling the printmasking system 75, 67 to correct the residual hue mismatch if present.

A new hue mismatch, however, can arise later—due for example to drift in colorant, media, pen characteristics, or even aging of the system, or most likely to combinations of these factors. Such a new mismatch can be countered by corrective revision of the numbers memorized in the firmware memory (sometimes of the type called "flash memory").

Such firmware updates for identified combinations of colorant, media, pen and system age can be distributed through the Internet or private networks. They can be installed in the field, by manual or automatic revision of the memory in each printer—if and when those corresponding combinations of variables come to be used in each printer.

Alternatively the printers can be programmed to determine the residual hue mismatch in the field, and then to apply the appropriate perturbations read out from preestablished relationships as described above. Again, the hue divergences under discussion in this subsection are extremely small, far more subtle than the hue shifts encountered without the more-basic features of the present invention.

(d) Correcting another colorant pair that has one colorant in common with the first—Without stepping again through all of the development in subsections (a) and (b) above, it can now be seen that precisely analogous steps strongly mitigate hue shift as between magenta and yellow, thereby minimizing such shift in formation of secondary red. This is accomplished by (i) deletion 62 of the magenta dot in the third pass 41*r*, for region 1—which, as before, also removes the magenta dot from blue 40*b*—and then proceeding through (ii) removal of the magenta dot from the second pass 46*r*, for region 2, then (iii) reweighting magenta and yellow to equalize their nominal quantities, in the two regions, and (iv) perturbing these weights to correct any residual magenta/yellow mismatch.

It might be supposed that step (iii) here, the magenta/yellow reweighting, must introduce another proportional reduction of the yellow dot in both regions—but in fact this is not required. The ⅓ reduction already taken to equalize yellow with cyan serves also to equalize the yellow with magenta; hence only the magenta values are physically changed at this point.

These steps are exactly parallel to those detailed earlier for cyan. The above-mentioned configuration file 81 (FIG. 5) is thus very straightforwardly made to include constraints 82–84 for correcting the additional colorant pair (magenta and yellow) discussed here.

(e) Relieving overconstraint for a third colorant pair—Dot restrictions for generation of blue emerge as a direct consequence of the combination of the previous cases. Due to cyan drop removal 61 from the third pass and top layer 41*g* to produce uniform green, and magenta removal 62 from that same third pass and top layer 41*r* to produce uniform red, neither cyan nor magenta is deposited in the first pass.

Generation of blue requires both cyan and magenta, and these removals account for all cyan and magenta in the first pass—including those 41*b* that would otherwise be used in making blue. Therefore the third swath in the first region can contribute nothing to generation of blue, and exactly the same is true in of the first swath (second pass) in the second region.

For this special case, the three-pass mode becomes a two-pass one. That in itself could be acceptable, but the green and red cases too are somewhat constrained as well—in a sense to a two-and-a-half-pass mode.

In practice the Shakes system, and probably any system that undertakes to make a good printmask at every try, requires some maneuvering room, some additional degrees of freedom, to solve the millions of neighborhood-constraint problems that it encounters along the way. Here, total available dots are reduced to precisely the number actually required to make saturated blue: in the first region there is one blue unit 42*b*, 43*b* in each of the two passes; and in the second region there is likewise just one blue unit 44*b*, 45*b* in each of the two passes.

This would reduce to zero the spare degrees of freedom that the masking program can exercise—but for the probability-weighted character of nearly all instructions in the Shakes system. Preferably the Shakes system, when operating with the present invention in service, maintains its own capability to find a complete mask at every try—by virtue of a weighting instruction 85 (FIG. 5) that specifies the balance or tradeoff between color-shift suppression on one hand, and satisfaction of neighborhood constraints or other common constraints on the other hand.

In another system not thus endowed, addition of an extra pass (e.g. manually) may be advisable. In such a case the total number of passes would be raised only from three to four; whereas in earlier printmasking efforts to merely camouflage hue shift, the number of passes is most typically eight or more.

For the sake of simplicity, much of the discussion of hue-shift suppression in this document is stated in terms of an essentially full optimization of drop sequence—and thereby complete elimination of direction-induced hue shifts. That is why in a three-pass mode with "2+2" drops all degrees of freedom for mask generation can be lost.

What has now been introduced, however, is an important and preferable form of the invention in which the suppressions prescribed by the invention are integrated more fully into the probability-weighted operations of Shakes. If a different weight is chosen, the system can find, for instance, a conceptually equal tradeoff between the hue-shift optimizations and neighborhood-constraint etc. optimizations (for these two optimization sets, a relative weight w=0.5)—or for example not optimizing the drop sequence at all (w=1.0).

Now rather than eliminating the third of three passes (full sequence optimization), the system can print just a small amount of the "forbidden" color with the third pass, or can use that color fully (neighborhood-constraint optimization, with no suppression of hue shift). This refinement is generally not required for a five-pass printmode, in which the basic printmasking task usually has more than ample degrees of freedom.

That is because, after reducing one pass for blue printing, four passes still remain for firing one drop; and likewise in the case of firing two magenta and two cyan drops on each pixel. In a single-pass draft mode, on the other hand, ordinarily the technique is simply not available, because typically all degrees of freedom are exhausted.

This technique, in a three-pass printmode for instance, thus allows for a solution that stops short of reducing certain colors in some passes to absolute zero. Instead the system is instructed to drive toward a tradeoff between a perhaps-imperceptible shift in the color and some degree of freedom for the masking process in, e.g., printing of blue.

In short, Shakes allows setting a weight to control relative predominance of (1) optimizing drop sequences and (2) optimizing fulfillment of the basic mask constraints—neighborhood constraints and the like. In essence the drop-sequence constraints of the present invention simply become just one more constraint (but a new one) of the overall Shakes structure of competing constraints.

Focusing, then, on a three-pass mode: normally the maximum number of drops that can be placed at each pixel is two; likewise for composite colors. Thus in the case of blue it is implied that one cyan drop and one magenta drop can be deposited at each pixel, and there are two passes for depositing each of these drops, so adequate degrees of freedom remain.

In the situation described in this document, when two cyan and two magenta drops are printed at each pixel, full masks are required—each pass must print one drop, respectively—no degrees of freedom remain. This worst case, however, is not entirely realistic; tradeoffs attainable through weighting can almost always mitigate this picture.

(f) Alternative combinations—Nozzle usage, however, is not necessarily affected by the suppression process—as different drop-order combinations may be used to compose the image. The order, though it must be consistent within any single image or plot, may vary from plot to plot—taking into account the nozzle-usage statistics.

For example, hue shift in green can be minimized by inhibiting the first yellow drop (see 43*g*) in the first region and the last yellow drop (see 44*g*) in the second, to equalize the yellow-cyan layer sequences at "CYC":

| region 1 | region 2 |
|---|---|
| C × ½ | C × ½ |
| Y × 1 | Y × 1 |
| C × ½ | C × ½, |

rather than "YCY" as tabulated earlier. This layer-sequence tabulation incorporates a proportional downweighting of cyan, analogous to that detailed above for yellow, thereby correcting both regions from slightly bluish-green to green.

Pursuing this strategy, hue shift in blue is minimized by inhibiting the first magenta drop (see 43*b*) in the first region, and the last magenta drop (see 44*b*) in the second region, to equalize the cyan-magenta layer sequences at "CMC" for both regions. The cyan downweighting just mentioned will correct not only green but also blue—from slightly greenish-blue. As before, an additional pass may be needed—but now to relieve the resulting overconstraint in formation of red.

From this brief description it can now be seen that still another approach is to minimize hue shift in red and blue can be minimized by inhibiting the last yellow and cyan drops (see 41*r*, 41*b*) in region 1 and the first yellow and cyan drops (see 46*r*, 46*b*) in region 2. In this case the corresponding proportional downweighting required is in magenta; and the added pass that may be needed is to relieve overconstraint in forming green.

2. Hardware for Implementing the Invention

As the invention is amenable to implementation in, or as, any one of a very great number of different printer models of many different manufacturers, little purpose would be served by illustrating a representative such printer. If of interest, however, such a printer and some of its prominent operating subsystems can be seen illustrated in several other patent documents of the assignee, Hewlett Packard.

(a) General mechanics and electronics—In some such representative printers, a cylindrical platen 41 (FIG. 5)—driven by a motor 42, worm and worm gear (suggested as encircling the platen 41) under control of signals from a digital electronic processor 71—rotates to drive sheets or lengths of printing medium 4A in a medium-advance direction. Print medium 4A is thereby drawn out of a supply of the medium and past the marking components that will now be described.

A pen-holding carriage assembly 20 carries several pens, as illustrated, back and forth across the printing medium, along a scanning track—perpendicular to the medium-advance direction—while the pens eject ink. For simplicity's sake, only four pens are illustrated; however, as is well known a printer may have six pens or more, to hold different colors—or different dilutions of the same colors as in the more-familiar four pens. The medium 4A thus receives inkdrops for formation of a desired image.

A very finely graduated encoder strip 33, 36 is extended taut along the scanning path of the carriage assembly 20 and read by a very small automatic optoelectronic sensor 37 to provide position and speed information 37B for one or more microprocessors 71 that control the operations of the printer. One advantageous location (not shown) for the encoder strip is immediately behind the pens.

A currently preferred position for the encoder strip 33, 36 (FIG. 5), however, is near the rear of the pen carriage—remote from the space into which a user's hands are inserted for servicing of the pens or refill cartridges. For either position, the sensor 37 is disposed with its optical beam passing through orifices or transparent portions of a scale formed in the strip.

The pen-carriage assembly 20, 20' is driven in reciprocation by a motor 31—along dual support and guide rails (not shown)—through the intermediary of a drive belt 35. The motor 31 is under the control of signals 31A from the processor or processors 71.

Preferably the system includes at least four pens holding ink of, respectively, at least four different colors. Most typically the inks include cyan C, then magenta M, yellow Y, and black K—in that order from left to right as seen by the operator. As a practical matter, chromatic-color and black pens may be in a single printer, either in a common carriage or plural carriages. Also included in the pen-carriage assembly 20, 20' is a tray carrying various electronics.

The pen-carriage assembly is represented separately at 20 when traveling to the left 16 while discharging ink 18, and at 20' when traveling to the right 17 while discharging ink 19. It will be understood that both 20 and 20' represent the same pen carriage, with the same pens.

The invention is not limited to operation in four-colorant systems. To the contrary, for example six-colorant "CMYKcm" systems including dilute cyan "c" and magenta "m" colorant are included in preferred embodiments.

The integrated circuits 71 may be distributive—being partly in the printer, partly in an associated computer, and partly in a separately packaged raster image processor. Alternatively the circuits may be primarily or wholly in just one or two of such devices.

These circuits also may comprise a general-purpose processor (e.g. the central processor of a general-purpose computer) operating software such as may be held for instance in a computer hard drive, or operating firmware (e.g. held in a ROM 77 and for distribution 66 to other components), or both; and may comprise application-specific integrated circuitry. Combinations of these may be used instead.

Before further discussion of details in the block diagrammatic showing of FIG. 5, a general orientation to that drawing may be helpful. This diagram particularly represents preferred embodiments of one previously discussed apparatus aspect of the invention.

Conventional portions of the apparatus appear as the printing stage 20 . . . 51, and 4A, discussed above, and also the final output-electronics stage 78 which drives that printing stage. In addition, most of the program modules are conventional, as detailed below.

(b) General program features—This final-output stage 78 in turn is driven by a printmasking stage 75, which is mostly but not entirely conventional, as set forth in earlier patent documents dealing with Shakes. This masking stage 75 operates according to the Shakes system to allocate printing of ink marks 18, 19 as among plural passes of the carriage 20, 20' and pens across the medium 4A. Thus the heart of the Shakes printmasking stage 75 comprises this function 67 of specific pass and nozzle assignments.

Also generally (but not wholly) in accordance with earlier-disclosed features of Shakes is a configuration file 81. Conceptually speaking, the configuration file 81 is partially inside and partially outside the Shakes pass-and-nozzle assignment module 67.

Although this file 81 quite directly and intimately controls operation of Shakes pass and nozzle assignments, nevertheless as pointed out earlier the configuration file 81 is kept very readily accessible to the system designer for just such modifications as those provided by preferred embodiments of the present invention. It is for this reason that it may be conceptualized as partially within and partially without the nozzle-and-pass module 67.

The great bulk of the configuration-file 81 contents, as well as the rest of the pass and nozzle functionality 67, is devoted to the truly myriad details (not illustrated) that are managed by the Shakes system as taught in earlier patent documents. The masking stage 75 and its configuration-file module 81, however, also include importantly nonconventional features according to preferred embodiments of the present invention as discussed below.

Also generally conventional are a nonvolatile memory 77, which holds and supplies operating instructions 66 (many of which are novel and implement the present invention)—including the configuration file 81—for all the programmed elements; an image-processing stage 73, rendition-and-scaling module 74; and color input data 70. The data flow as input signals 191 into the processor 71.

Nonconventional features particularly related to preferred embodiments of the present invention are within the masking module 75; these will be detailed below. Given the statements of function and the diagrams presented in this document, a programmer of ordinary skill—if experienced in this field—can prepare suitable programs and configuration statements for operating all the circuits.

The previously mentioned digital processor 71 provides control signals 20B, 20'B to fire the pens with correct timing, coordinated with platen drive control signals 42A to the platen motor 42, and carriage drive control signals 31A to the carriage drive motor 31. The processor 71 develops these carriage drive signals 31A based partly upon information about the carriage speed and position derived from the encoder signals 37B provided by the encoder 37.

(In the block diagram all illustrated signals are flowing from left to right except the information 37B fed back from the sensor 37—as indicated by the associated leftward arrow.) The codestrip 33, 36 thus enables formation of color inkdrops at ultrahigh precision during scanning of the carriage assembly 20 in each direction—i.e., either left to right (forward 20') or right to left (back 20).

(c) Novel program features—Features of preferred embodiments of the present invention per se are primarily in the printmasking stage 75, and particularly within two portions 81, 85 of that stage. More specifically, within the configuration file 81 are the three suppressing means 82-84 discussed above in subsections 1(*a*) through 1(*e*) of this "DETAILED DESCRIPTION" section.

Also specifically, the automatic relative-weighting module 85 contributes an important novel step, when considered as part of a new combination with those suppressing means. The new step preserves the operation of Shakes itself in the face of hue-shift control mechanisms that would otherwise deny Shakes sufficient degrees of freedom to operate—i.e., to find at every try a mask that satisfies the neighborhood constraints and other conditions specified as inputs to Shakes.

This is true, even though generally speaking the automatic provision of probability-weighted commands is part of the Shakes regimen, because the suppressing modules 82–84 directly push the system into the overconstrained condition. That new step is discussed in subsection 1(*f*) above.

As can now be seen, one of the most striking aspects of preferred embodiments of this invention is that an excellent form of direct solution to the hue-shift problem is achieved with only just a few lines of constraint code in the configuration file 81. The resulting cost effectiveness for this solution to a previously knotty problem is excellent.

The above disclosure is intended as merely exemplary, and not to limit the scope of the invention—which is to be determined by reference to the appended claims.

What is claimed is:

1. Apparatus for printing an image with multiple colorants, onto a printing medium; said apparatus comprising:

plural pens, each ejecting a different such colorant respectively and each having an array of multiple nozzles;

means for operating each pen to eject successive installments of such colorants, subject to varying colorant-addressing sequences; and means for operating a program to control the nozzles individually to deposit such colorants in an order that maintains substantially consistent colorant-addressing sequences.

2. The apparatus of claim 1, wherein:

some colorant-addressing layers in said substantially consistent colorant-addressing sequences comprise different numbers of installments.

3. The apparatus of claim 1, wherein:

with respect to each portion of such medium, in each installment the pen-operating means alternate between two fixed but opposite pen sequences; and the program-operating means comprise means for maintaining said substantially consistent colorant-addressing sequences notwithstanding operation of the pens in said opposite sequences.

4. The apparatus of claim 3, further comprising:

a carriage for transporting the pens in a fixed configuration across such medium in alternating directions, thereby causing the pen-operating means to alternate between the two fixed but opposite pen sequences.

5. The apparatus of claim 4, further comprising:

a mechanism that advances the printing medium, at right angles to the carriage motion, substantially only between each successive pair of carriage transits.

6. The apparatus of claim 5, wherein:

the maintaining means minimize hue shift as between colors formed in the two pen sequences respectively.

7. The apparatus of claim 1, wherein:

the program-operating means comprise means for suppressing use of particular nozzles in particular installments to maintain said substantially consistent colorant sequences.

8. The apparatus of claim 7:

further comprising printmasking means for allocating particular image pixels, in respective colors, to colorant deposition in particular installments; and wherein the suppressing means comprise constraints on operation of the printmasking means.

9. A method of printing a color image on a printing medium, by construction from individual marks formed by scanning multinozzle pens; said method comprising the steps of:

passing the pens multiple times across the medium while firing the nozzles to form the marks; and suppressing firing of particular nozzles in particular passes to produce a substantially fixed, specified color bias as between colorants of at least one colorant pair.

10. The method of claim 9, further comprising the step of:

selectively applying a relative downweighting in printing of one colorant, to substantially correct said color bias;

wherein the applying step produces substantially equal overall gross addressed quantities of the colorants.

11. The method of claim 10, wherein:

to minimize residual hue mismatch as between different image regions, the applying step further comprises using statistical weights perturbed from nominal weighting values that would only nominally equalize said overall colorant quantities.

12. The method of claim 9, wherein:

the suppressing step comprises inhibiting particular marks of a certain colorant, to maintain substantially consistent colorant-addressing sequences within the colorant pair.

13. The method of claim 12, further comprising the step of:

selectively applying a relative downweighting in printing of another colorant, to substantially correct said color bias;

wherein the applying step produces substantially equal overall gross addressed quantities of said certain colorant relative to said other colorant.

14. The method of claim 9, wherein the suppressing step comprises:

inhibiting printing of at least two colorants, to produce a substantially fixed, specified color bias as between colorants of two colorant pairs.

15. The method of claim 14, further comprising the step of:

further comprising the step of expressly setting a relative weight for the predominance of the suppressing step in relation to neighborhood constraints or other constraints, or both.

16. The method of claim 15, wherein:

said expressly setting step comprises controlling printing of colors requiring said two colorants;

the two colorants are cyan and yellow; and said secondary color is blue.

17. The method of claim 9, further comprising the steps of:

printmasking to allocate particular image pixels, in particular colors, to marking in particular passes; and constraining said printmasking to implement the suppressing step.

18. A method for incremental printing of a color image; said method comprising the steps of:

operating a printmask-generating program that automatically creates a usable mask based upon neighborhood constraints and timing constraints specified to the program in advance;

specifying, to the program, constraints to minimize or eliminate hue shift; and printing the image with a resulting mask.

19. The method of claim 18, for use in printing the image on a printing medium; and wherein:

the constraints comprise inhibiting particular marks of a particular colorant to substantially equalize colorant-addressing sequences in different parts of the image.

20. The method of claim 19, wherein:

said substantially equalizing comprises equalization of colorant-layer sequences, without regard to varying number of colorant installments in some colorant layers.

21. The method of claim 19, for use in printing the image on a printing medium; and wherein:

the constraints comprise downweighting of printing with another colorant, to substantially equalize colorant-addressing concentrations of said particular colorant and said other colorant.

22. The method of claim 21, wherein:

to avoid residual hue mismatch between image regions, the downweighting uses weights perturbed from values that would only nominally equalize concentrations.

23. The method of claim 22:

wherein the constraints also comprises inhibiting particular marks of a different colorant, to substantially equalize further colorant-addressing sequences that include said different colorant; and further comprising the step of expressly setting a relative weight for the predominance of the hue-shift-minimizing constraints in relation to other constraints.

24. The method of claim 23, wherein:

said expressly setting step comprises controlling printing of colors requiring said particular colorant and said different colorant.

* * * * *

UNITED STATES PATENT AND TRADEMARK OFFICE

CERTIFICATE OF CORRECTION

PATENT NO. : 6,851,793 B2
APPLICATION NO. : 10/349063
DATED : February 8, 2005
INVENTOR(S) : Sascha de peña It is certified that error appears in the above-identified patent and that said Letters Patent is hereby corrected as shown below:

In column 2, line 13, delete “11'14 15'” and insert -- 11'-15' --, therefor.

In column 5, line 51, after “by” delete “is”.

In column 12, line 18, after “aggregate” delete “9”.

Signed and Sealed this

Fourth Day of August, 2009

John Doll

JOHN DOLL
*Acting Director of the United States Patent and Trademark Office*